United States Patent [19]

Lunsford

[11] Patent Number: 4,902,262

[45] Date of Patent: Feb. 20, 1990

[54] POWER UNIT AND BATTERY PACK FOR TOYS

[76] Inventor: David W. Lunsford, 3317 Mackey La., Shreveport, La. 71118

[21] Appl. No.: 78,877

[22] Filed: Jul. 27, 1987

[51] Int. Cl.[4] ..... A63H 3/00; A63H 33/00; A63H 29/22; A63H 5/04

[52] U.S. Cl. ..... 446/268; 446/473; 446/484; 446/405

[58] Field of Search ..... 446/26, 90, 236, 268, 446/405, 473, 484, 485

[56] References Cited

U.S. PATENT DOCUMENTS

| | | | |
|---|---|---|---|
| 3,054,217 | 9/1962 | D'Amato | 446/236 |
| 3,545,126 | 12/1970 | Brown | 446/236 |
| 3,594,947 | 7/1971 | Hartling et al. | 446/268 |
| 3,695,148 | 10/1972 | Baginski et al. | 446/268 X |
| 3,925,924 | 12/1975 | Schoenfield | 446/139 |
| 3,949,517 | 4/1976 | Reiner et al. | 446/26 |
| 4,267,551 | 5/1981 | Dankman et al. | 446/303 X |
| 4,626,222 | 12/1986 | Sweet | 446/268 |
| 4,696,654 | 9/1987 | Welch et al. | 446/405 X |
| 4,710,146 | 12/1987 | Rasmussen et al. | 446/473 X |

FOREIGN PATENT DOCUMENTS

| | | | |
|---|---|---|---|
| 2186203 | 8/1987 | United Kingdom | 446/473 |

OTHER PUBLICATIONS

E. Bushmiller, The Washington Daily News, "Nancy", Apr. 14, 1960.

*Primary Examiner*—Robert A. Hafer
*Assistant Examiner*—Michael Brown
*Attorney, Agent, or Firm*—John M. Harrison

[57] ABSTRACT

A power unit and battery pack for toys, which power unit is characterized by an electric motor mounted in a housing and adapted for gripping by a figure toy or character and driving various accessories. The power unit is powered by one or more batteries located in a battery pack strapped to the back of the figure toy and the battery is connected to the power unit by means of an electric cord. Both "on-off" and pressure switches are provided, with the "on-off" switch preferably located in the battery pack and the pressure switch positioned on the power unit for selectively activating the power unit motor and operating the selected accessory. Alternative wiring arrangements are disclosed. A shaft adaptor is fitted to the shaft of the electric motor in the power unit, in order to accommodate a wide variety of accessories such as blades, fans and other rotating implements used in connection with the toy figure toy.

16 Claims, 1 Drawing Sheet

POWER UNIT AND BATTERY PACK FOR TOYS

BACKGROUND OF THE INVENTION

1. Field of the Invention

This invention relates to battery powered toys and more particularly, to a power unit and battery pack for both self-propelled and unpropelled figure toys and characters, which power unit is designed for gripping by the toy figures figure toys and the battery pack is fitted to the backs of the for supplying power to the power unit. The power pack contains one or more batteries and is fitted with an "on-off" switch and an optional pressure switch for supplying power through an electric cord to the power unit. The power unit is further provided with a pressure switch and a shaft adaptor for fitting on the shaft of an electric motor located in the power unit to drive various accessories used in connection with the figure toys.

Motion pictures such as the epic "Star Wars" and similar motion pictures have resulted in a proliferation of various self-propelled and unpropelled toy figures and characters which are widely available to children. Many of these figure toys and characters are futuristic in design and perform various functions using a wide variety of equipment. The most popular figure toys characters incorporate simulated laser weapons and equipment depicted in the motion picture epics. The figure toys and characters are typically constructed of injection-molded plastic materials and range from the popular "GI-Joe" character, which originated after World War II, to the "Star Wars" alien creatures and robots which were created with great diversity in design and appearance.

2. Description of the Prior Art

Many of the toys currently on the market today are battery-driven and utilize various electrically operated equipment. For example, U.S. Pat. No. 4,209,941, dated July 1, 1980, details "Grounded Flying Saucer Toys". The patent discloses a motorized toy vehicle adapted to travel over a floor under its own power and to cimulate, on a miniaturized scale, a popular concept of a space vehicle referred to as a "Flying Saucer". The toy includes a drive for propelling the vehicle along the floor, a revolving dome-shaped covering having a series of windows, through which a vari-colored flashing light is seen and a battery compartment for receiving and containing batteries that operate a drive motor which drives the toy vehicle. "Electrical Power Packs and Charging Devices" are disclosed in U.S. Pat. No. 4,389,469, dated June 21, 1983, to Bryan F. Nicholls. The power pack disclosed in this patent is used as an alternative to non- rechargeable batteries in a toy and includes multiple, series-connected, rechargeable cells mounted in a casing which is sealed permanently against removal of the cells and carries output terminals arranged to cooperate with the power input terminals of the toy when the power pack is inserted in power-supplying position in a toy. The contact terminals of the cells are adapted to interact with a recharging device when the power pack is engaged, for recharging the cells. The power pack casing is shaped to cooperate with the toy for supplying power to the toy motor and driving the toy. U.S. Pat. No. 4,438,589, dated Mar. 27, 1984, to Matsushiro, discloses a "Moving Toy With Movable Battery Receptacle". The moving toy has a front wheel and a rear wheel supported on a body and is capable of operating in normal mode with the front and rear wheels engaging the ground and in a "wheelie" mode with the front wheels raised. A battery is supplied in a battery receptacle for providing electric power to operate the toy. The center of gravity of the battery receptacle is located forward of the rear wheel axle when the toy is operating in the normal mode and rearwardly of the rear wheel axle when the toy is operating in the "wheelie" mode. The battery receptacle includes a spring-biased stopper located on a stop lever for engaging grooves provided on a surface of a vehicle body to retain the battery receptacle in a fore or an aft position or in intermediate positions therebetween. A "Cassette-Type Power Unit For A Motor Toy" is disclosed in U.S. Pat. No. 4,514,477, dated Apr. 30, 1985, to Kobayashi. The cassette-type power unit includes a rectangular casing provided at its middle part with a partition. Connecting terminals for connecting a plurality of batteries in series are also provided, along with contact pieces which act as power terminals located on an outer face of the casing. Holding pieces are each provided with a flange for serving as a guide and a stopper upon connection to the motor toy. The cassette-type power unit facilitates the convenient replacement of batteries, especially for a wireless-controllable toy car and enables a variety of controlling operations to be readily effected by use of a single unit.

It is an object of this invention to provide a new and improved power unit and battery pack for various figure toys and characters, wherein various accessories can be driven by the power unit and powered by one or more batteries located in the battery pack to simulate selected actions and activities using the figure toy or character.

Another object of this invention is to provide a power unit and battery pack for use with figure toys and characters, wherein the power unit can be placed in the hand or hands of a figure toy or character by application of multiple selected handle arrangements in the power unit and the battery pack is strapped to the back of the figure toy or character to power various accessories coupled to the power unit.

Yet another object of this invention is to provide a power unit and battery pack for application to figure toys and characters, wherein the battery-powered power unit can be activated by one or more pressure switches to operate various accessories removably attached to the power unit and simulate selected actions by the figure toy or character.

SUMMARY OF THE INVENTION

These and other objects of the invention are provided in a power unit and battery pack for use with both self-propelled and unpropelled figure toys and characters, which power unit can be held by a figure toy or character using one of several multiple handle configurations. The battery pack is strapped to the back of the figure toy or character to power certain accessories responsive to manipulation of one or more switches and simulate certain moves and operations undertaken by the figure toy or character.

BRIEF DESCRIPTION OF THE DRAWING

The invention will be better understood by reference to the accompanying drawing, wherein.

DESCRIPTION OF THE PREFERRED EMBODIMENTS

Figure 1:
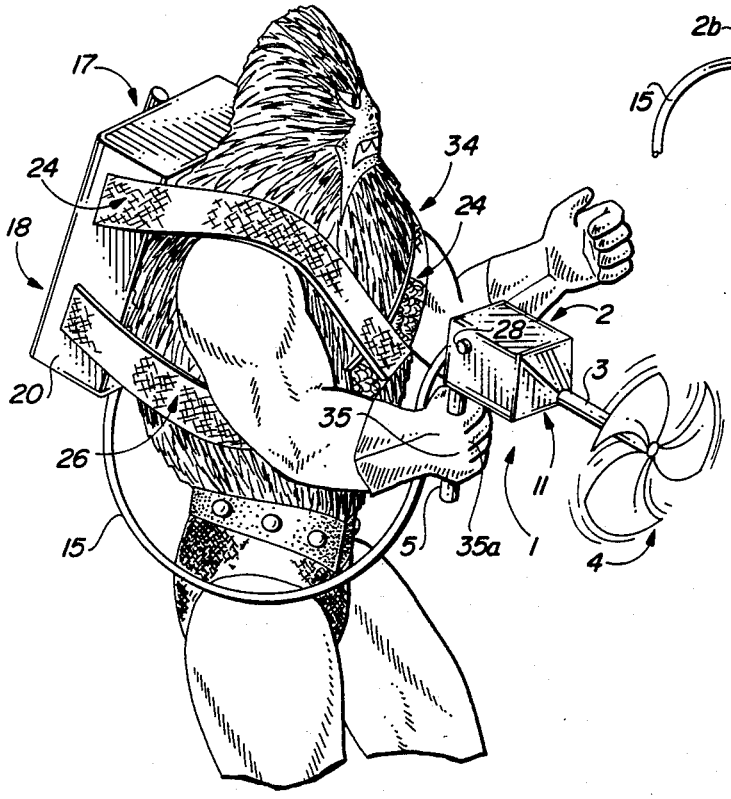
FIG. 1 is a perspective view of a figure toy having a battery pack strapped on the back thereof and carrying a power unit according to this invention.
Figure 2:
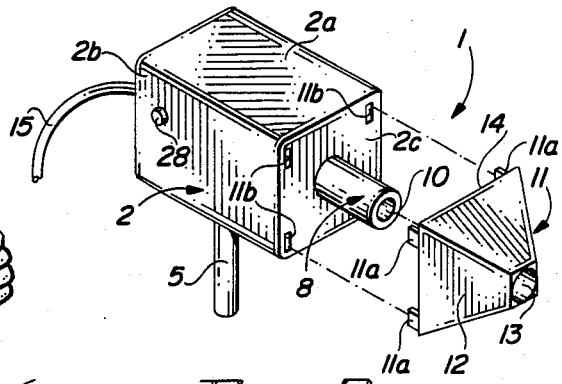
FIG. 2 is a perspective view of a preferred power unit for simulated handling by the figure toy illustrated in FIG. 1.
Figure 3:
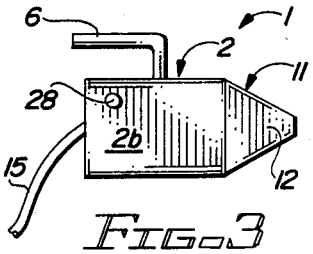
FIG. 3 is a side view of the power unit illustrated in FIG. 2, more particularly illustrating an alternative preferred handle arrangement in the power unit.

Referring initially to FIGS. 1–4 of the drawing, the power unit component of the power unit and battery pack of this invention is generally illustrated by reference numeral 1. The power unit 1 is characterized by a motor enclosure or housing 2, defined by a housing top panel 2a, parallel housing side panels 2b and a housing front panel 2c. A housing bottom panel and rear panel (not illustrated) close the motor housing 2 and enclose an electric motor (not illustrated) having a motor shaft (not illustrated) which extends through the housing front panel 2c and into one end of the adaptor opening 10 of a shaft adaptor 8, as illustrated in FIG. 2. An accessory stabilizer cap 11 is fitted on the housing front panel 2c of the motor housing 2, as illustrated in FIG. 2 and the stabilizer base 14 of the accessory stabilizer cap 11 is designed to coincide with the perimeter of the housing front panel 2c and tapers forwardly to define a stabilizer tip 12, having a tip opening 13 in the center thereof. In a preferred embodiment of the invention the accessory stabilizer cap 11 is fitted with projecting cap tabs 11a, for insertion in the companion tab slots 11b, located in the housing front panel 2c, in order to removably mount the accessory stabilizer cap 11 on the motor housing 2 and provide access to the shaft adaptor 8. Accordingly, an accessory shaft such as the blade shaft 3, carrying a plastic or rubber blade 4, as illustrated in FIG. 1, is inserted through the tip opening 13 of the accessory stabilizer cap 11 and into the adaptor opening 10 of the shaft adaptor 8, to maintain the blade 4 in rotatable connection with the motor shaft (not illustrated) of the power unit 1. A bottom handle 5 projects downwardly from fixed attachment to the bottom panel (not illustrated) of the motor housing 2 and is adapted for insertion into the right hand 35 of the figure toy 34, in order to simulate operation of the power unit 1 by the figure toy 34, as illustrated in FIG. 1. A pressure switch 28 is also provided in one of the housing side panels 2b of the motor housing 2, to facilitate operation of the power unit 1 and rotation of the blade 4 by a child playing with the figure toy 34. Referring now to FIG. 3 of the drawing, an L-shaped top handle 6 extends from fixed attachment to the housing top panel 2a of the motor housing 2 as an alternative means for carrying and handling the power unit 1 by the figure toy 34. Furthermore, referring to FIG. 4 of the drawing, in another alternative embodiment of the power unit 1, a pair of side handles 7 extend from fixed attachment to opposite housing side panels 2b of the motor housing 2 to facilitate grasping of the power unit 1 by both hands of a figure toy or character such as the figure toy 34 and operating an accessory such as the plastic or rubber blade 4 by a child playing with the figure toy 34.

Figure 5:
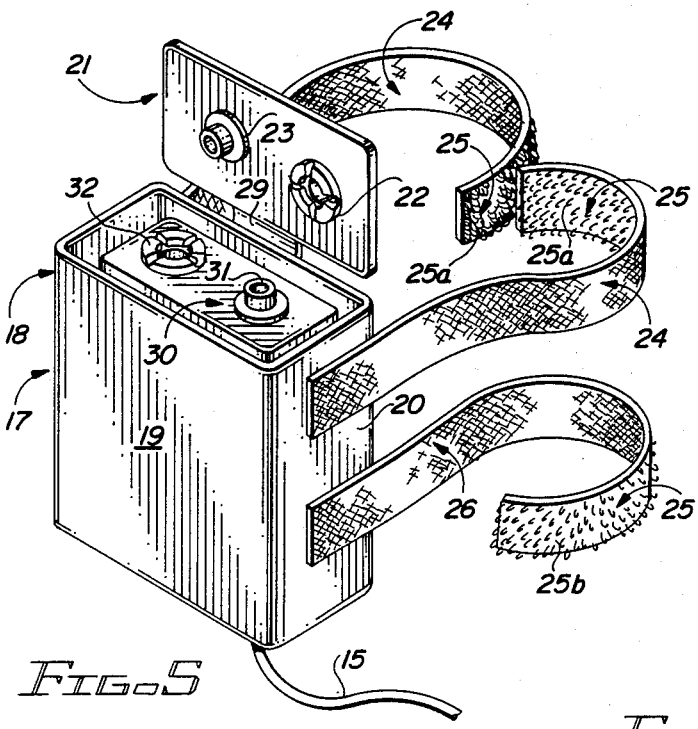
FIG. 5 is a perspective view of the battery pack illustrated in FIG. 1.

Referring now to FIG. 5 of the drawing a battery pack is generally represented by reference numeral 17 and is characterized by a battery housing 18, which receives and encloses a rectangular-shaped conventional battery 30. The receptacle housing 18 is further characterized by a front panel 19, a pair of parallel side panels 20, a rear panel 16 and a bottom panel (not illustrated). A closure panel 21 is secured to the rear panel 16 by means of a hinge 29 and a male connector 23 and female connector 23 are attached to the underside of the closure panel 21 in spaced relationship. The male connector 23 is designed to removably attach to the positive terminal 32 and the female connector 22 to the negative terminal 31, of the battery 30 when the closure panel 21 is closed over the battery 30. A length of electrical wiring 15 extends from the electric motor in the motor housing 2 of the power unit 1 to the battery 30 in the battery pack 17 for powering the power unit 1, as hereinafter described. A pair of top straps 24 extend from the upper portion of the side panels 20 and a pair of bottom straps 26 extend from the bottom portion of the side panels 20, as illustrated. Fastening elements of the loop-pile fasteners 25 are attached to the top straps 24 and the bottom straps 26. Accordingly, the loop elements 25a, secured to the top straps 24 and the pile elements 25b, secured to the bottom straps 26, are joined, respectively, when the top straps 24 and bottom straps 26 are crossed over the chest of the figure toy 34, in order to removably secure the battery pack 17 to the back of the figure toy 34, as illustrated in FIG. 1. It is understood that other attachment devices such as pegs, bands, belts, snaps, wires, in non-exclusive particular can also be employed to secure the battery pack 17 to the figure toy 34.

Figure 6:
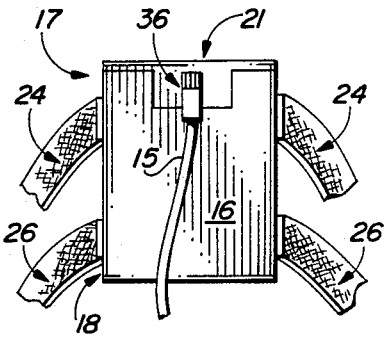
FIG. 6 is a rear view of the battery pack illustrated in FIG. 5, wherein the battery pack is fitted with a rotating "on-off" switch.
Figure 7:
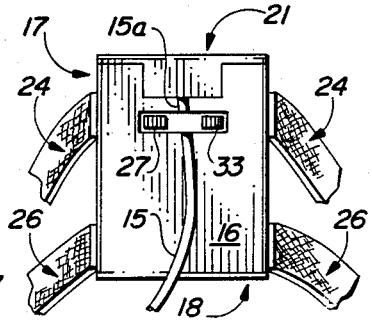
FIG. 7 is a rear view of the battery pack illustrated in FIG. 5, wherein the battery pack is fitted with an alternative slide on-off switch and a motor activation switch.

Referring now to FIGS. 5–7 of the drawing and to FIG. 6 in particular, a rotary switch 36 is secured to the rear panel 16 of the battery housing 18 for supplying power to the power unit 1 through the electrical wiring 15. One end of the electrical wiring 15 is wired into the rotary switch 36 and to the male connector 23 and the female connector 23, located in the closure panel 21 and the other end is either wired directly into the windings of the electric motor (not illustrated) located in the motor housing 2 or to the pressure switch 28, which pressure switch 28 is wired into the windings of the electric motor. Referring to FIG. 7 of the drawing, in an alternative embodiment, a fixed switch 27 is provided in optional cooperation with a motor activation switch 33 in the battery housing 18, to enable continuous electrical transmission to the electric motor (not illustrated) located in the motor housing 2, while selective energizing of the electric motor is enabled by opening and closing of the electric circuit by operation of the motor activation switch 33. The electric lead 15a extends from the fixed switch 27 and/or the motor activation switch 33 into the closure panel 21 and electrically connects the fixed switch 27 and/or the motor activation switch 33 to the male connector 23 and the female connector 22. In a third alternative embodiment the pressure switch 28 located in the motor housing 2 can be wired directly from the electrical wiring 15 into the windings of the electric motor to facilitate operation of the electric motor by pressing the pressure switch 28.

Referring again to FIG. 1 of the drawing, when the power unit and battery pack for toys of this invention is used, the power unit 1 is first mounted in the right hand 35 of the figure toy 34 by closing the fingers 35*a* around the bottom handle 5. The battery pack 17 is then strapped to the back of the figure toy 34 by lapping the top straps 24 and the bottom straps 26 across the chest of the figure toy 34 and securing the respective loop elements 25*a* to the companion pile elements 25*b*. Referring again to FIG. 6 of the drawing, under circumstances where the battery housing 18 of the battery pack 17 is fitted with the rotary switch 36 illustrated in FIG. 6, the rotary switch 36 can be first manipulated to the "on" position, to enable operation of the electric motor (not illustrated) inside the motor housing 2 of the power unit 1 by manipulating the pressure switch 28 to the "on" position. Alternatively, as illustrated in FIG. 7, if the battery pack 17 is fitted with the combination fixed switch 27 and motor activation switch 33, the motor activation switch 33 can be initially slidably manipulated to the "on" position to enable operation of the electric motor in the power unit 1 by manipulating the fixed switch 27 provided in the battery housing 18 to the "on" position. Further in the alternative, under circumstances where the pressure switch 28 is wired directly into the motor windings from the electrical wiring 15, the electric motor is operated by pressing the pressure switch 28. Furthermore, it will be recognized that the pressure switch 28 can be located on the battery pack 17 in place of the rotary switch 36.

An accessory such as the rubber or plastic blade 4 can be attached to the motor housing 2 by aligning the blade shaft 3 of the blade 4 with the tip opening 13 located in the stabilizer tip 12 of the accessory stabilizer cap 11 and inserting the blade shaft 3 into the adaptor opening 10 provided in the projecting end of the shaft adaptor 8. The opposite end of the shaft adaptor 8 is secured to the motor shaft (not illustrated) attached to the electric motor located in the motor housing 2, as heretofore described. Accordingly, activation of either the pressure switch 28, the motor activation switch 33, the fixed switch 27 or the rotary switch 36 where a rotary switch is utilized, in the desired combinations then causes the blade 4 to rotate responsive to operation of the electric motor. Various other accessories such as fans and other accessories known to those skilled in the art can be utilized in connection with the power unit 1.

Figure 4:
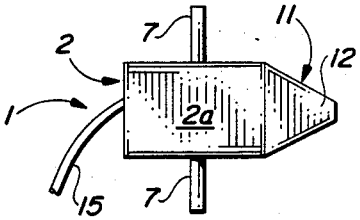
FIG. 4 is a top view of the power unit illustrated in FIGS. 2 and 3, more particularly illustrating a third preferred alternative handle arrangement in the power unit.

It will be appreciated by those skilled in the art that the power unit 1 can be held by the figure toy 34 in a number of different ways, depending upon the provision of the bottom handle 5 illustrated in FIG. 2, the top handle 6 illustrated in FIG. 3 or the pair of side handles 7 illustrated in FIG. 4. Accordingly, the power unit 1 can be held with one or both hands of the figure toy 34, depending upon the choice of the power unit 1, the particular function desired and the accessory used with the power unit 1.

It is understood that while the battery pack 17 is illustrated with a single battery 30 provided therein, the battery housing 18 can be enlarged and shaped to receive additional batteries 30, without departing from the spirit and scope of the invention. Furthermore, the battery pack 17 can be adapted to contain alternative electrical power sources such as solar cells, chemical sources and like energy sources, in non-exclusive particular, and while the figure toy 34 is illustrated as a futuristic figure which is the product of space-age motion pictures, other conventional figures such as the "GI-Joe" character and similar figure toys and characters can be used to implement the power unit and battery pack of this invention.

Referring again to FIGS. 1–4 of the drawing it is further understood that the accessory stabilizer cap 11 can be alternatively permanently mounted on the motor housing 2 under circumstances where it is constructed of heavy wire material to facilitate coupling of the blade shaft 4 to the shaft adaptor 8 with the accessory stabilizer in place.

While the preferred embodiments of the invention have been described above it will be recognized and understood that various modifications may be made therein and the appended claims are intended to cover all such modifications which may fall within the spirit and scope of the invention.

Having described my invention with the particularity set forth above, what is claimed is:

1. A power unit and battery pack for a toy, said power unit comprising an electric motor having a rotating shaft; a motor housing for containing said electric motor, with said shaft of said electric motor projecting from said motor housing; adaptor means carried by said shaft of said electric motor, accessory stabilizer means provided on said motor housing and an opening provided in said accessory stabilizer means, said opening provided substantially in alignment with said shaft and said adaptor means for receiving an accessory having an accessory shaft and operating the accessory responsive to coupling of the accessory shaft to said adaptor means; and handle means carried by said motor housing for grasping said power unit; and further comprising battery pack means adapted for attachment to the toy, said battery pack means further adapted to receive at least one source of electrical energy for poweringsaid power unit and electric wiring connecting the source of electrical energy to said electric motor for energizing said electric motor and operating said power unit.

2. The power unit and battery pack of claim 1 further comprising:

(a) first switch means provided in electrical contact with said electric wiring for enabling the supply of electric power from the source of electrical energy to said electric motor; and (b) pressure switch means provided in electrical contact with said electric wiring for selectively supplying electric power from the source of electrical energy to said electric motor responsive to manipulation of said first switch means to the "on" position.

3. The power unit and battery pack of claim 1 wherein said toy further comprises a figure toy, said source of electrical energy is a battery and said battery pack means further comprises a generally rectangular battery housing and a pair of battery connectors secured to said battery housing in spaced relationship, said battery connectors adapted for removable attachment to the positive terminal and negative terminal of the battery and further comprising:

(a) first switch means mounted on said battery housing and provided in electrical contact with said electric wiring for enabling the supply of electric power from the battery to said electric motor;

(b) pressure switch means mounted in said motor housing and provided in electrical contact with said electric wiring for selectively supplying electric power from the battery to said electric motor responsive to manipulation of said first switch means to the "on" position; and (c) attachment means connected to said battery pack means for removably securing said battery pack means to the toy.

4. The power unit and battery pack of claim 3 wherein said handle means further comprises a single handle projecting from the bottom of said housing.

5. The power unit and battery pack of claim 3 wherein said handle means further comprises an L-shaped handle projecting from the top of said housing.

6. The power unit and battery pack of claim 3 wherein said handle means further comprises a pair of handles projecting from opposite sides of said housing.

7. A combination power unit and battery pack for a figure toy, said battery pack comprising an electric motor having a rotating shaft; a housing adapted for containing said electric motor, with said shaft of said electric motor rotatably projecting from said housing; adaptor means carried by said shaft of said electric motor, an accessory stabilizer cap provided on said motor housing and an opening provided in said accessory stabilizer cap, said opening provided substantially in alignment with said shaft and said adaptor means for receiving an accessory having an accessory shaft and operating the accessory responsive to coupling of the accessory shaft to said adaptor means; and handle means carried by said housing for grasping said power unit by the figure toy; and further comprising battery pack means adapted for attachment to the figure toy, said battery pack means containing at least one battery for powering said electric motor; electric wiring connecting the battery to said electric motor; and switch means provided in electrical contact with said electric wiring for selectively energizing said electric motor and operating said power unit.

8. The power unit and battery pack of claim 7 further comprising pressure switch means provided in said housing, said pressure switch means also provided in electrical contact with said electric wiring for selectively energizing said power unit responsive to activation of said switch means.

9. The power unit and battery pack of claim 7 further comprising strap means connected to said battery pack means for removably securing said battery pack means to the toy.

10. The power unit and battery pack of claim 9 wherein said battery pack means further comprises a generally rectangular battery housing and a pair of battery connectors secured to said battery housing in spaced relationship, said battery connectors adapted for removable attachment to the positive terminal and negative terminal of the battery and wherein said strap means further comprises at least one pair of straps extending across the chest of the toy figure.

11. The power unit and battery pack of claim 7 further comprising a pressure switch provided in said housing, said pressure switch also provided an electrical contact with said electric wiring for selectively energizing said power unit responsive to activation of said switch means.

12. The power unit of claim 7 wherein said handle means further comprises a single handle projecting from the bottom of said housing.

13. The power unit of claim 7 wherein said handle means further comprises an L-shaped handle projecting from the top of said housing.

14. The power unit of claim 7 wherein said handle means further comprises a pair of handles projecting from opposite sides of said housing.

15. A power unit and battery pack for a figure toy, said power unit comprising an electric motor having a rotating shaft; a housing adapted for containing said electric motor, with said shaft of said electric motor projecting from said housing; adaptor means carried by said shaft of said electric motor; an accessory stabilizer cap provided on said motor housing, said accessory stabilizer cap substantially enclosing said adaptor means and an opening provided in said accessory stabilizer cap, said opening provided substantially in alignment with said shaft and said adaptor means for receiving an accessory having an accessory shaft and operating the accessory responsive to coupling of accessory shaft to said adaptor means; and handle means carried by said housing for grasping said power unit by the figure toy; and further comprising a generally rectangular battery pack adapted for mounting on the back of the figure toy and a battery provided in said battery pack; strap means carried by said battery pack, said strap means adapted for extending across the chest of the figure toy and securing said battery pack to the figure toy; electric wiring connecting the battery to said electric motor; and enabling switch means provided in electrical contact with said electric wiring for enabling the energizing of said power unit.

16. The power unit and battery pack of claim 15 further comprising pressure switch means provided in said housing, said pressure switch means provided in electric contact with said electric wiring for selectively energizing said power unit responsive to activation of said enabling switch means.

* * * * *